US009193914B2

(12) United States Patent
Morrell

(10) Patent No.: US 9,193,914 B2
(45) Date of Patent: Nov. 24, 2015

(54) COKE OVEN ASSEMBLIES, DOORS THEREFOR, AND METHODS

(71) Applicant: Trident Fluid Power, LLC, Franklin, OH (US)

(72) Inventor: Carl James Morrell, Middletown, OH (US)

(73) Assignee: Trident Fluid Power, LLC, Franklin, OH (US)

( * ) Notice: Subject to any disclaimer, the term of this patent is extended or adjusted under 35 U.S.C. 154(b) by 217 days.

(21) Appl. No.: 13/766,414

(22) Filed: Feb. 13, 2013

(65) Prior Publication Data

US 2014/0202846 A1 Jul. 24, 2014

Related U.S. Application Data

(60) Provisional application No. 61/756,387, filed on Jan. 24, 2013.

(51) Int. Cl.
*C10B 25/16* (2006.01)

(52) U.S. Cl.
CPC ..... *C10B 25/16* (2013.01); *Y10T 29/49826* (2015.01)

(58) Field of Classification Search
CPC .... C10B 25/06; C10B 25/16; Y10T 29/49826
USPC ..... 202/248, 269, 267.1, 268
See application file for complete search history.

(56) References Cited

U.S. PATENT DOCUMENTS

| | | | | |
|---|---|---|---|---|
| 2,007,318 | A * | 7/1935 | Wilhelm | 202/248 |
| 2,698,289 | A | 12/1954 | Wolff | |
| 3,505,174 | A * | 4/1970 | McCampbell et al. | 202/248 |
| 4,028,193 | A * | 6/1977 | Nagayoshi | 202/248 |
| 4,337,122 | A | 6/1982 | Kurihara | |
| 4,427,494 | A | 1/1984 | Naevestad | |
| 4,486,271 | A * | 12/1984 | Lorenz | 202/248 |
| 4,770,749 | A | 9/1988 | Schlösser | |
| 4,800,970 | A | 1/1989 | Taylor | |
| 5,238,539 | A | 8/1993 | Baird | |
| 5,443,696 | A | 8/1995 | Baird et al. | |
| 5,674,449 | A * | 10/1997 | Liang et al. | 420/12 |
| 6,916,406 | B2 | 7/2005 | Baird | |
| 8,528,410 | B2 | 9/2013 | Popp | |

* cited by examiner

*Primary Examiner* — Jill Warden
*Assistant Examiner* — Joye L Woodard
(74) *Attorney, Agent, or Firm* — Ulmer & Berne LLP

(57) ABSTRACT

A coke oven door includes a mainframe, a diaphragm assembly coupled with the mainframe, and a plurality of load-exerting assemblies attached to the mainframe. The diaphragm assembly includes a pan and a sealing edge structure attached to the pan. The sealing edge structure includes a load-receiving surface, a door-sealing surface spaced from the load-receiving surface, and a plurality of scallops spaced from one another. Each of the load-exerting assemblies is positioned and configured to selectively, operably apply a load to the load-receiving surface of the sealing edge structure. The scallops are configured and positioned to facilitate deflection of the sealing edge structure, in response to loads applied to the load-receiving surface, such that the door-sealing surface is configured to be positioned in contacting, and at least substantially sealing, engagement with a door jamb of a coke oven body.

13 Claims, 12 Drawing Sheets

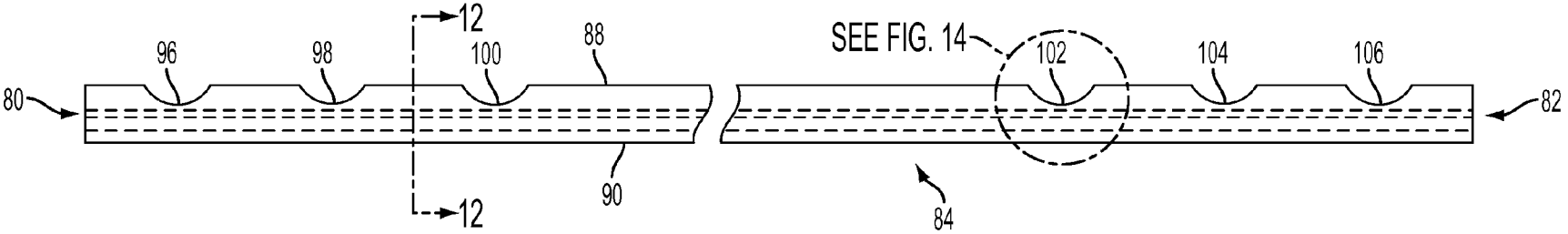
FIG. 11
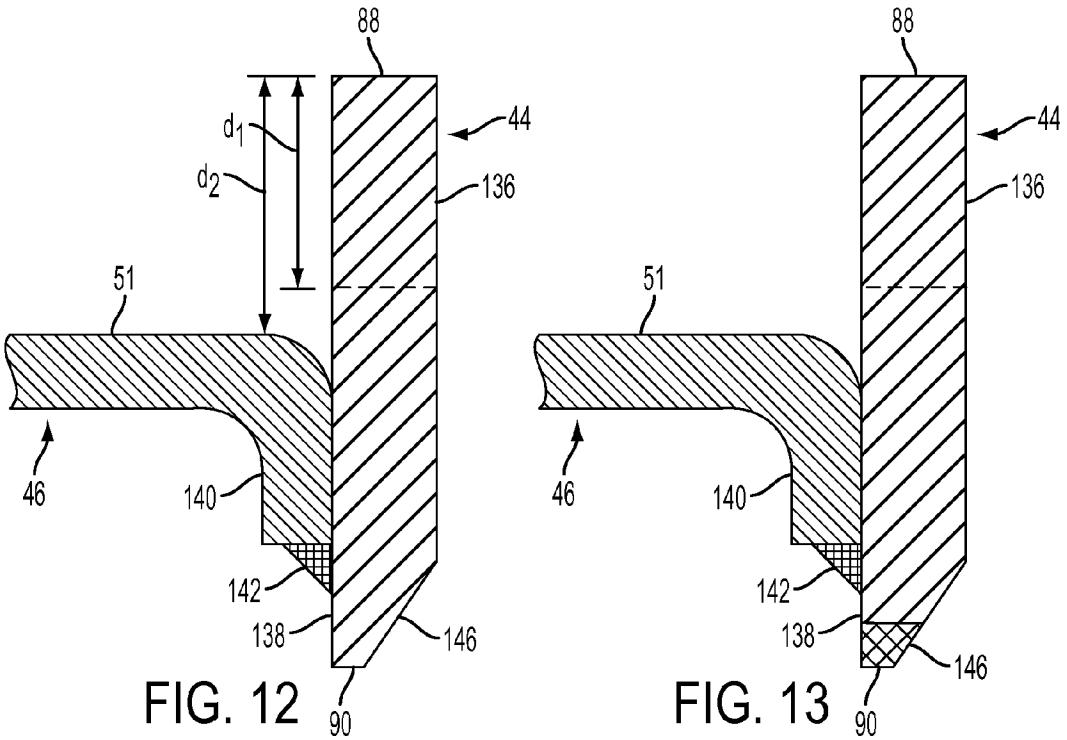
FIG. 12
FIG. 13
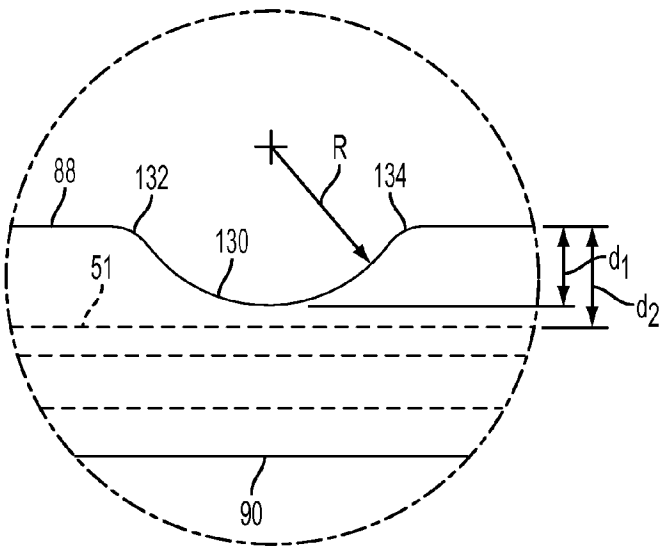
FIG. 14

COKE OVEN ASSEMBLIES, DOORS THEREFOR, AND METHODS

CROSS REFERENCE TO RELATED APPLICATION

This application claims the priority benefit of U.S. Provisional Patent Application Ser. No. 61/756,387, "Coke Oven Doors, Sealing Edges Therefor, and Methods", filed Jan. 24, 2013, which is hereby expressly incorporated by reference herein in its entirety.

TECHNICAL FIELD

The present disclosure relates generally to coke oven assemblies, and more particularly, to doors of coke oven assemblies.

BACKGROUND

Coke oven assemblies are known that include an oven body, which defines an interior chamber, and a door releasably attached to the oven body. Coal is heated within the interior chamber, to a sufficiently high temperature to force volatiles out of the coal, leaving lightweight coke.

SUMMARY

According to one embodiment, a coke oven assembly includes an oven body defining an interior chamber configured to receive a product to be heated. The oven body includes a wall structure and a door jamb attached to the wall structure. The door jamb defines an opening in communication with the interior chamber. The coke oven assembly also includes a door. The door includes a diaphragm assembly that includes a pan and a sealing edge structure. The sealing edge structure is attached to the pan about a perimeter of the pan. The sealing edge structure includes a load-receiving surface, a door-sealing surface spaced from the load-receiving surface, and a plurality of scallops that are spaced from one another. The door also includes a mainframe releasably secured to the door jamb. The diaphragm assembly is coupled with the mainframe. The door also includes a plurality of load-exerting assemblies attached to the mainframe. Each of the load-exerting assemblies is positioned and configured to selectively, operably apply a load to the load-receiving surface of the sealing edge structure. The scallops are configured and positioned to facilitate deflection of the sealing edge structure, in response to loads applied to the load-receiving surface of the sealing edge structure, such that the door-sealing surface is positioned in contacting, and at least substantially sealing, engagement with the door jamb.

According to another embodiment, a coke oven door includes a diaphragm assembly that includes a pan and a sealing edge structure attached to the pan about a perimeter of the pan. The sealing edge structure includes a load-receiving surface, a door-sealing surface spaced from the load-receiving surface, and plurality of scallops that are spaced from one another. The coke oven door also includes a mainframe. The diaphragm assembly is coupled with the mainframe. The coke oven door also includes a plurality of load-exerting assemblies attached to the mainframe. The load-exerting assemblies are spaced from one another, and each of the load-exerting assemblies is positioned and configured to selectively, operably apply a load to the load-receiving surface of the sealing edge structure. The scallops are configured and positioned to facilitate deflection of the sealing edge structure, in response to loads applied to the load-receiving surface of the sealing edge structure, such that the door-sealing surface is configured to be positioned in contacting, and at least substantially sealing, engagement with a door jamb of a coke oven.

According to yet another embodiment, a diaphragm assembly for a coke oven door includes a pan and a sealing edge structure attached to the pan. The sealing edge structure includes a load-receiving surface and a door-sealing surface spaced from the load-receiving surface. The sealing edge structure also includes means for facilitating deflection of the sealing edge structure in response to loads applied to the load-receiving surface of the sealing edge structure, such that the door-sealing surface is configured to be positioned in contacting, and at least substantially sealing, engagement with a door jamb of a coke oven.

According to another embodiment, a method of manufacturing a coke oven door is provided. The coke oven door includes a diaphragm assembly, a mainframe, and a plurality of load-exerting assemblies. The diaphragm assembly includes a sealing edge structure and a pan attached to the sealing edge structure. The sealing edge structure includes a load-receiving surface and a door-sealing surface spaced from the load-receiving surface. The diaphragm assembly is coupled with the mainframe. The plurality of load-exerting assemblies are attached to the mainframe and spaced from one another. Each of the load-exerting assemblies is positioned and configured to selectively, operably apply a load to the load-receiving surface of the sealing edge structure. The method includes assembling at least a portion of at least one of the load-exerting assemblies. The method also includes forming a plurality of scallops in the sealing edge structure to be spaced from one another. The scallops are configured and positioned to facilitate deflection of the sealing edge structure, in response to loads applied to the load-receiving surface of the sealing edge structure, such that the door-sealing surface is configured to be positioned in contacting, and at least substantially sealing, engagement with a door jamb of a coke oven.

According to another embodiment, a method of sealing an interior chamber of a coke oven assembly is provided. The coke oven assembly includes a door jamb that defines, and surrounds, an opening communicating with the interior chamber. The method includes inserting a refractory of a coke oven door into the interior chamber of the coke oven. The method also includes forcing a door-sealing surface of a sealing edge structure of the coke oven door into contacting, and at least substantially sealing, engagement with the door jamb. The door-sealing surface is spaced from a load-receiving surface of the sealing edge structure. The method also includes releasably securing a mainframe of the coke oven door to the door jamb. The forcing includes selectively applying loads to the load-receiving surface at a plurality of locations. At least some of the locations are positioned between respective pairs of a plurality of scallops of the sealing edge structure. The scallops are spaced from one another.

BRIEF DESCRIPTION OF THE DRAWINGS

Various embodiments will become better understood with regard to the following description, appended claims and accompanying drawings wherein:

FIG. 11 is a side elevational view depicting the diaphragm assembly of FIG. 10;

FIG. 12 is a cross-sectional view taken along line 12-12 in FIG. 11;

FIG. 13 is a cross-sectional view similar to FIG. 12, but with a tip of the sealing edge structure being formed from a different material than that shown in FIG. 12;

FIG. 14 is an enlarged view of an encircled portion of FIG. 11;

DETAILED DESCRIPTION

Figure 1:
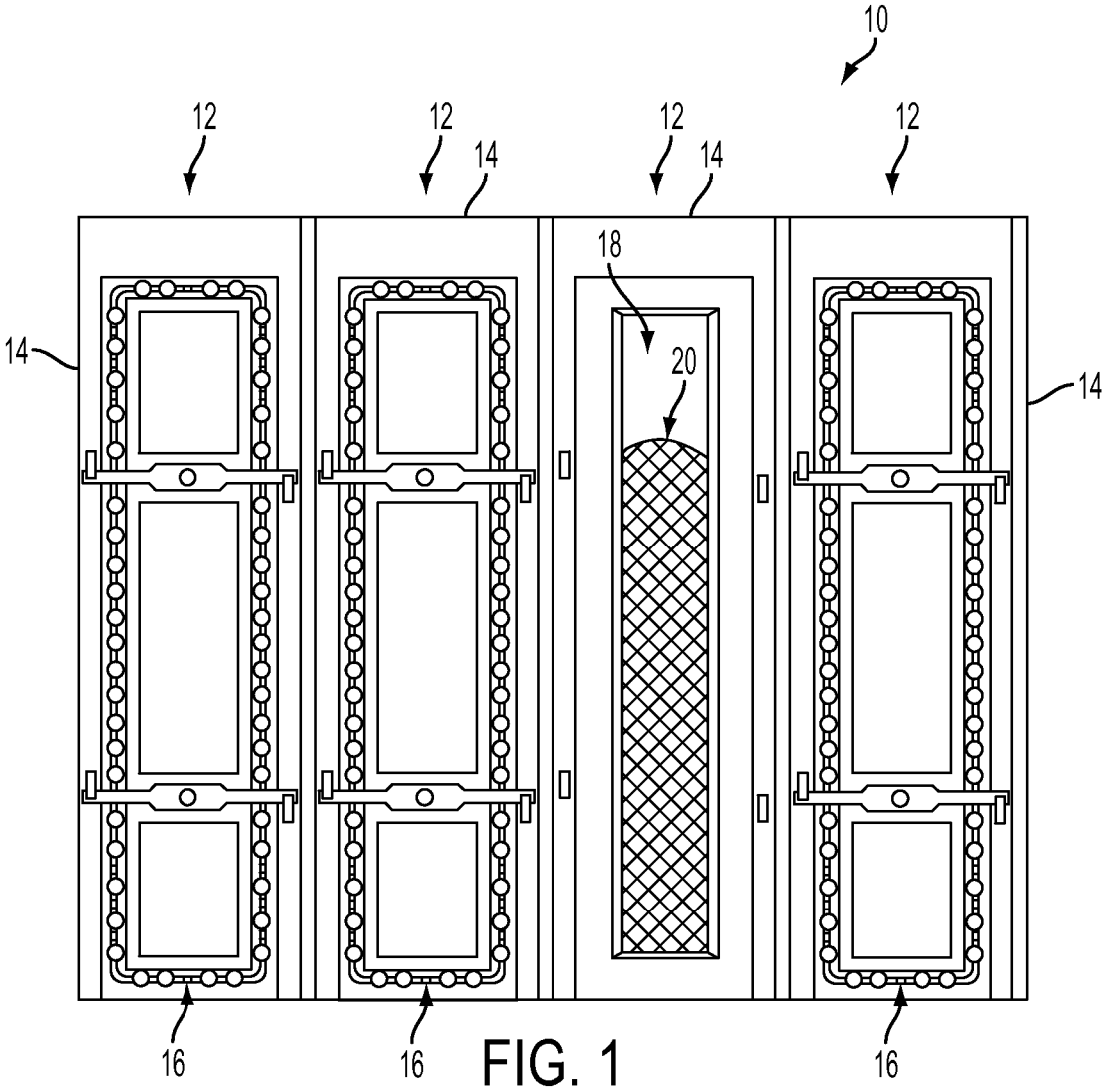
FIG. 1 is a front elevation view depicting a portion of a battery of coke oven assemblies, with one of the coke oven assemblies being depicted without a door installed, and with three additional coke oven assemblies being depicted with a door, according to one embodiment, installed and in a closed position.

Selected embodiments are hereinafter described in detail in connection with the views and examples of FIGS. 1-17, 18A and 18B. Coke ovens are industrial devices that convert coal to coke. Coke is used as a heat source in blast furnaces which produce the molten iron needed for steel making. Some coke ovens are chambers that are 2' wide by 14' tall and 70' long, and are arranged side by side in numbers of 76 to 100 ovens. The composite arrangement of all the ovens together is called a battery. The coal is heated within the coke oven chambers, e.g., to approximately 2000 degrees F. or more, sufficient to force the volatiles out of the coal leaving a lightweight coke, the desired product. During this heating process, the coal is protected from incoming oxygen to prevent it from burning into an undesirable ash. Protection from oxygen contamination is achieved by slightly pressurizing the oven. Pressurization of the oven requires that it be sealed from the atmosphere to the extent possible, not only for the depletion of oxygen, but more significantly to prevent volatiles from escaping into the atmosphere.

Each end of each oven has a door, in some cases approximately 2' wide by 14' tall. In order to remove the coke from the ovens, both doors of an oven are removed, and devices are used to push the coke from one side of the oven and then capture it outside the other side of the oven. After the removal of the coke, the doors are replaced, the oven is recharged with coal (e.g., from ports in the top), and the coking process begins another cycle.

Each door has a sealing edge around its perimeter that contacts the frame or jamb. Any loss of contact of this sealing edge against the frame can result in gasses and volatiles escaping into the atmosphere. The frames are exposed to extreme temperatures, resulting in warping over time. Sealing springs are therefore conventionally provided to urge the door's sealing edge against the frame, and are routinely adjusted to vary the amount of spring force provided by the door's sealing edge against the frame in the area of the leak. The conventional door sealing arrangement thus involves a balance of all of the sealing springs used to force the sealing edge against the frame, and a latching device (also containing springs) that holds the door in position.

For example, in one conventional configuration, a ⅜" thick bar of 304 stainless steel, 2¼" wide, provides the sealing edge. This bar is part of a fabrication called a "pan" that is secured between the door's mainframe and the door's protective refractory. The sealing springs are mounted on the mainframe around the perimeter of the door, and arranged so that they contact the top edge of the sealing edge around the door. These springs are used to adjust the pressure of the sealing edge against the frame through an assembly of adjustment components. In another conventional configuration, flat carbon steel backing plates are provided to force an Inconel knife edge against the frame of the oven under force of adjustable sealing springs.

As a frame ages, it can warp beyond the capabilities of adjustment of the conventional door's sealing edge and springs. As the sealing springs are adjusted to compensate for a warped oven frame, they may reach the point that they bottom out in an attempt to deform the sealing edge to match the contour of the frame. This can be caused by extreme rigidity of a stainless steel bar used to form the sealing edge. When the adjusting springs bottom out, they can upset the mounting balance of the entire door assembly, which can cause other areas of the sealing edge to leak gasses into the atmosphere. A similar problem can also occur with the configuration that uses backing plates with an Inconel sealing edge. This latter design also has an additional problem, in that it is much wider and therefore more vulnerable to mechanical damage.

The most significant warping of the frames can occur at the top and bottom portions of the frames, and less significantly in the middle portions. However, conventional doors are configured to provide for equal adjustment of the sealing edge along the entire perimeter, which can allow for severe leaks to occur at the top and/or bottom of a door that engages a severely warped frame. Conventionally, when sealing springs are incapable of facilitating a seal between a sealing edge and a frame, an operator can apply spray sealing agents to provide a temporary patch. However, spray sealing agents can reduce the door's ability to dissipate heat, and can accordingly be detrimental to the useful life of the door.

The door of FIGS. 1-17, 18A and 18B include an improved sealing edge structure that has greater flexibility at its four corners, which can reduce or eliminate the above-described sealing problem(s). FIG. 1 illustrates a portion of a battery 10 of coke oven assemblies 12, with four of the coke oven assemblies 12 being depicted. Each of the coke oven assemblies 12 can include an oven body 14. Each of the coke oven assemblies 12 can also include two doors 16, according to one embodiment. One of the doors 16 can be releasably secured to each end of a respective oven body 14. One end of each of three of the coke oven assemblies 12 depicted in FIG. 1 are shown with one of the doors 16 releasably secured to a respective oven body 14. FIG. 1 also illustrates one of the coke oven assemblies with a respective door removed. The oven body 14 of each coke oven assembly 12 can define an interior chamber 18. The interior chamber 18 can be configured to receive a product to be heated, for example coal. Hot gasses within the interior chamber 18 can heat the coal to approximately 2000 degrees F., or more, which can be sufficient to force the volatiles out of the coal, leaving a lightweight coke, indicated generally at 20 in the interior chamber 18.

The oven body 14 of each of the coke oven assemblies 12 can include a wall structure 22 and a door jamb 24 (FIG. 3) attached to the wall structure 22. The door jamb 24 can define an opening 26 that can communicate with the interior chamber 18. Each of the coke oven assemblies 12 can also include a plurality of door attachment members 28 (FIGS. 2 and 3), which can be attached to the wall structure 22 and/or the door jamb 24, and can cooperate with the door 16 to releasably secure the door 16 to the oven body 14, as subsequently discussed. In one embodiment, the wall structure 22 can be formed from brick or other refracting material, and the door jamb 24 can be formed from steel.

Figure 4:
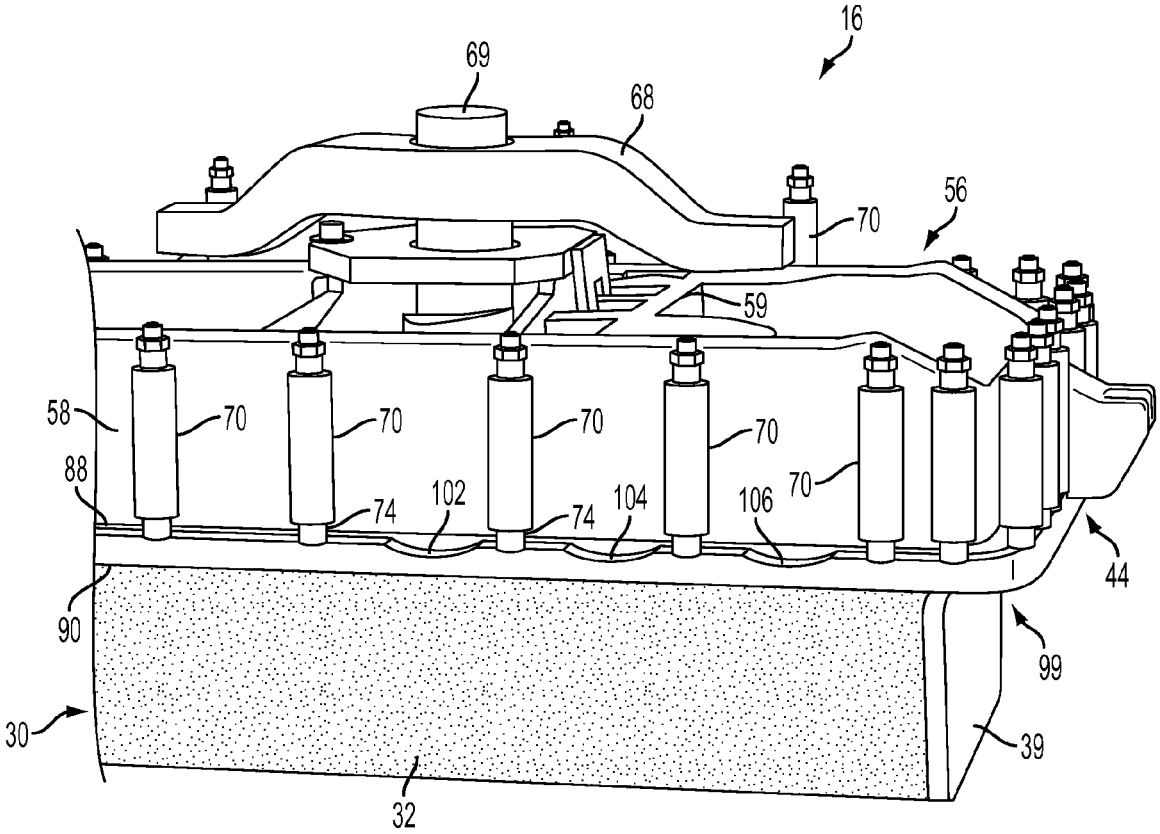
FIG. 4 is a perspective view of a portion of one of the doors of FIG. 1 apart from the remaining components of the battery of FIG. 1.
Figure 5:
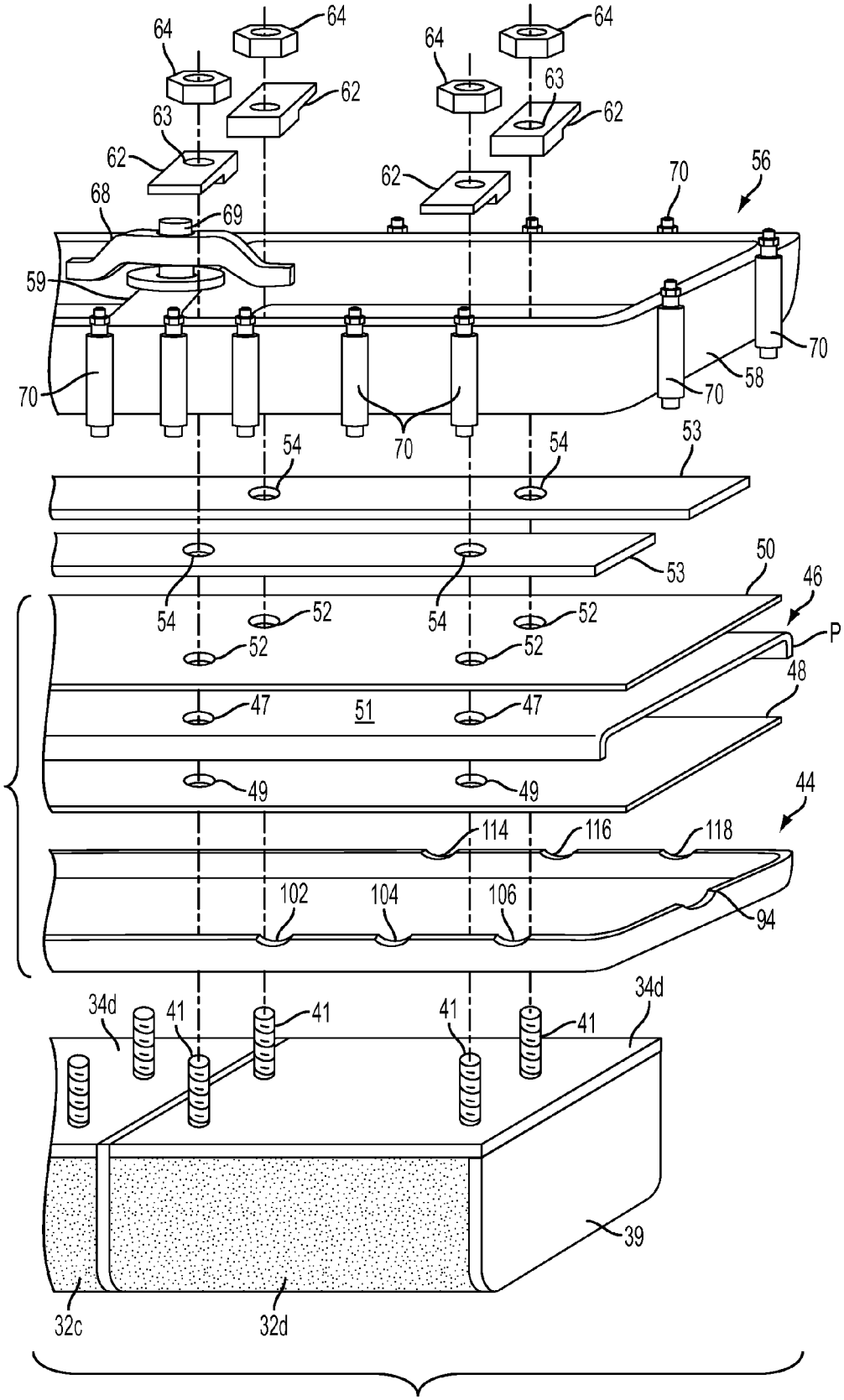
FIG. 5 is an exploded perspective view of a portion of the door of FIG. 4, wherein certain portions of the door are shown schematically or removed for clarity of illustration.
Figure 6:
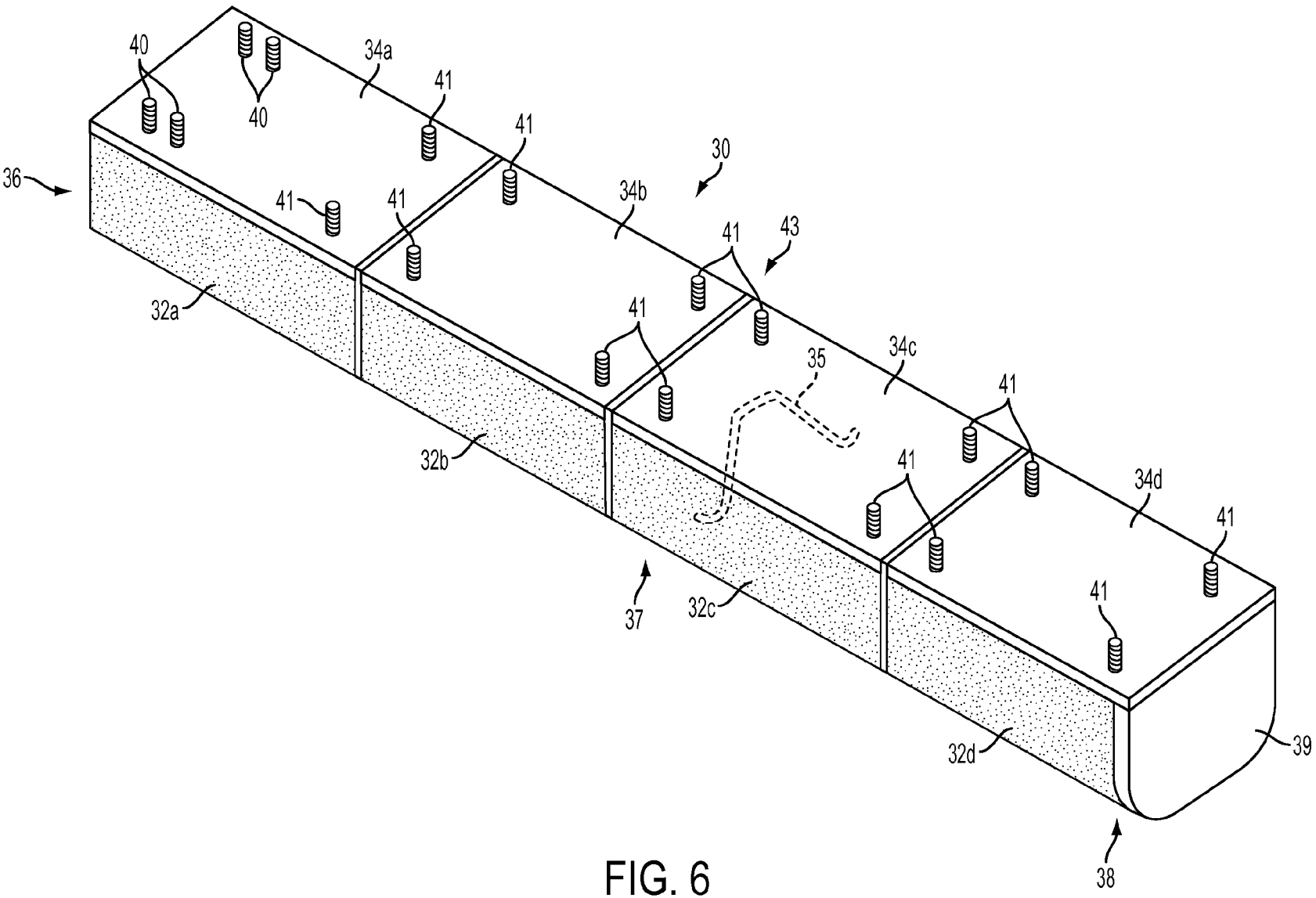
FIG. 6 is a perspective view of a refractory structure of the door of FIG. 5.
Figure 7:
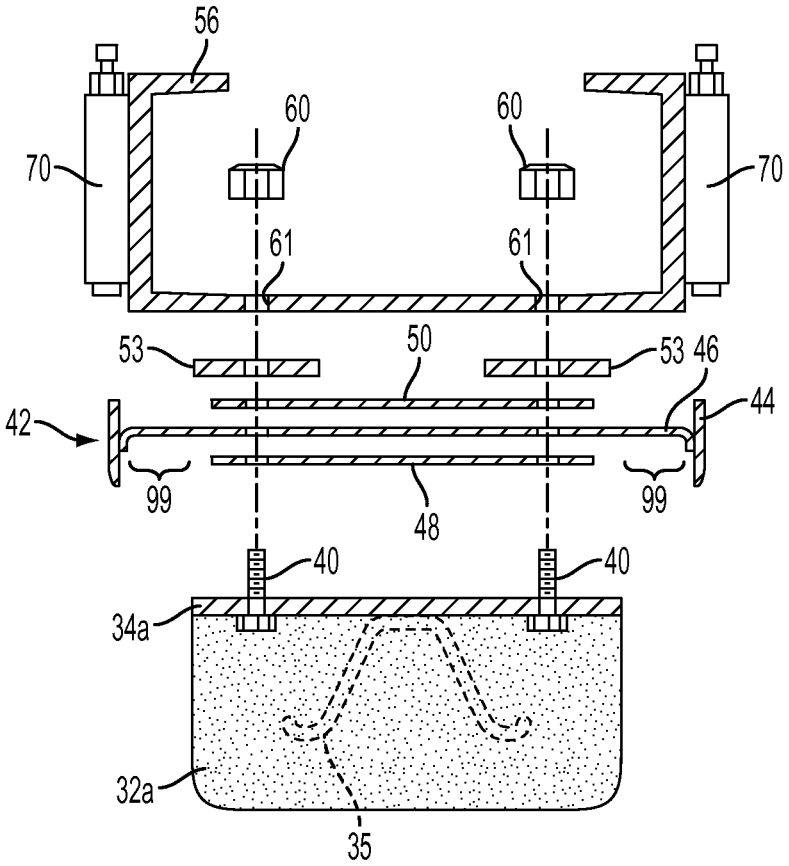
FIG. 7 is an exploded cross-sectional view of the door of FIG. 5.
Figure 8:
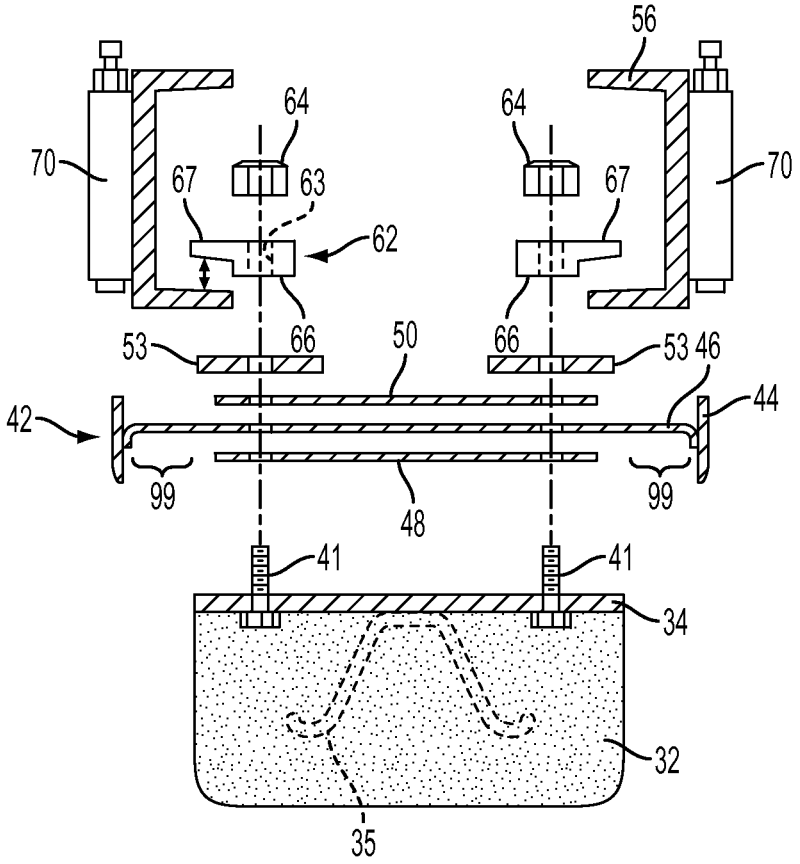
FIG. 8 is an exploded cross-sectional view of the door of FIG. 5.

Referring to FIGS. 4-8, each door 16 can include a refractory structure 30 that can be positioned, at least substantially, within the interior chamber 18 of a respective oven body 14. The refractory structure 30 can include a refractory 32 and a front reinforcement plate 34, as shown in FIG. 8. Refractory 32 can include a top end 36 and a bottom end 38, as shown in FIG. 6. Refractory 32 can include a plurality of sections, with each section being made of any suitable refractory material, for example, high temperature concrete. In one embodiment, the refractory 32 can include four sections, designated 32*a*, 32*b*, 32*c*, and 32*d* in FIG. 6. In other embodiments, the refractory can include five sections, or other numbers of sections. Adjacent sections of the refractory 32 can be pressed together from one end (36, 38) toward the other end (36, 38) for example using a hydraulic press, with a suitable material, such as insulating board positioned between each adjacent section of the refractory 32, which can facilitate sealing the interface between each adjacent pair of sections of the refractory 32. Alternatively, sections can be formed integrally. In other embodiments, for example when an oven door is used on the "pusher" side of the oven body 14, a top one of the sections of refractory can be replaced with a window or a refractory structure door that can be opened, such as to allow a leveling bar to be inserted through the refractory structure door, and into the interior chamber 18 to level the top of newly installed coal. In yet other embodiments an oven door can include any of a variety of other suitable arrangements of refractory sections or a different type of refractory structure.

In one embodiment, the front reinforcement plate 34 can include four plate sections, which are designated 34*a*, 34*b*, 34*c* and 34*d* in FIG. 6. Each of the plate sections 34*a*, 34*b*, 34*c* and 34*d* can be secured to a respective section of refractory 32. For example, plate sections 34*a*, 34*b*, 34*c* and 34*d* can be secured to the refractory sections 32*a*, 32*b*, 32*c* and 32*d*, respectively. The front reinforcement plate 34 can be secured in any suitable manner to the refractory 32, for example using a plurality of reinforcing rods that can have various shapes. In one embodiment, a plurality of hangers 35 (one shown in FIG. 6), which can have curved, generally "ram horn" shapes, can be welded to the front reinforcement plate 34 and can be embedded the refractory 32, as shown in FIG. 6 with regard to one of the hangers 35, front reinforcement plate 34*c* and refractory section 32*c*. The refractory structure 30 can also include one or more end reinforcement plates. For example, in one embodiment, the refractory structure 30 can include a bottom end reinforcement plate 39, which can be secured to the section 32*d* of refractory 32, for example using one or more hangers (e.g., similar to 35). Plate sections, for example sections 34*a*, 34*b*, 34*c* and 34*d*, can be formed separately or integrally as a unitary structure.

The refractory structure 30 can also include male fasteners, which can be used in conjunction with mating female fasteners of door 16, to interconnect the components of door 16. In one embodiment, the refractory structure 30 can include a plurality of bolts 40, which can be fixed to the plate section 34*a*, which is a top portion of the reinforcement plate 34. In one embodiment, each bolt 40 can pass through a respective aperture in the plate section 34*a*, and a head of each bolt 40 can be fixed, for example tack-welded, to the "refractory side" of plate section 34*a*. While four of the bolts 40 are shown in FIG. 6, other embodiments can include different numbers and/or arrangements of the bolts 40. The refractory structure 30 can also include a plurality of bolts 41. The heads of the bolts 41 can be fixed (e.g., tack-welded) to the "refractory side" of each of the plate sections 34*a*, 34*b*, 34*c* and 34*d*, as shown in FIG. 6. In one embodiment, two of the bolts 41 can be fixed to the plate section 34*a*, and four of the bolts 41 can be fixed to each of the plate sections 34*b*, 34*c* and 34*d*, for a total of fourteen of the bolts 41. In one embodiment, half of the bolts 41 can be positioned adjacent a first side 37 of the refractory structure 30, and half of the bolts 41 can be positioned adjacent a second side 43 of the refractory structure 30. In other embodiments, different numbers of the bolts 41 can be used, and/or the bolts 41 can be arranged differently, for example if a different number of refractory sections and plate sections are used, such as five refractory sections and five plate sections.

Figure 10:
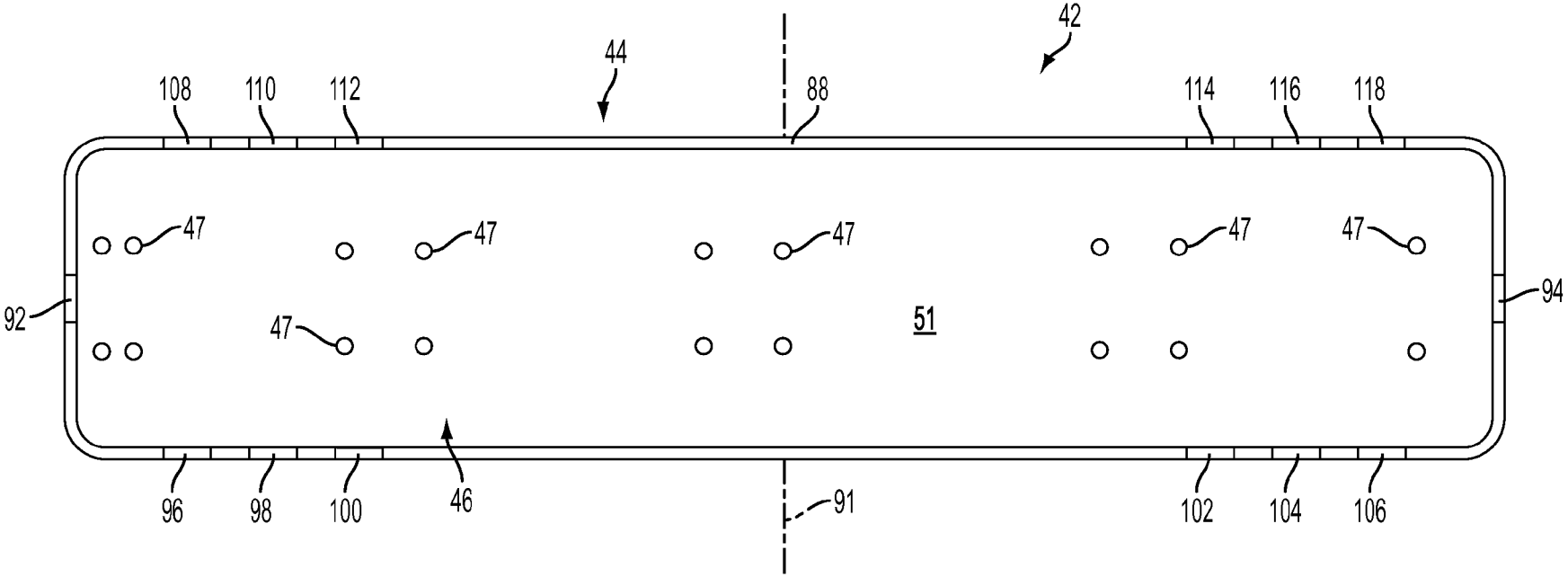
FIG. 10 is a top plan view depicting the diaphragm assembly apart from the remaining components of the door of FIG. 5.
Figure 15:
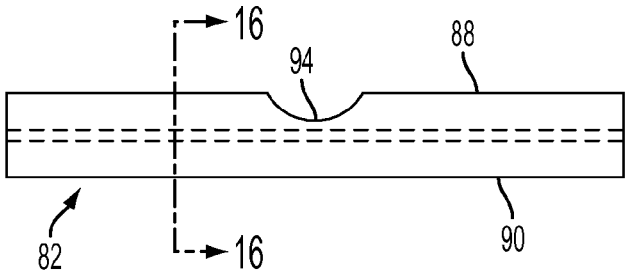
FIG. 15 is an end elevational view depicting the diaphragm assembly of FIG. 10.
Figure 16:
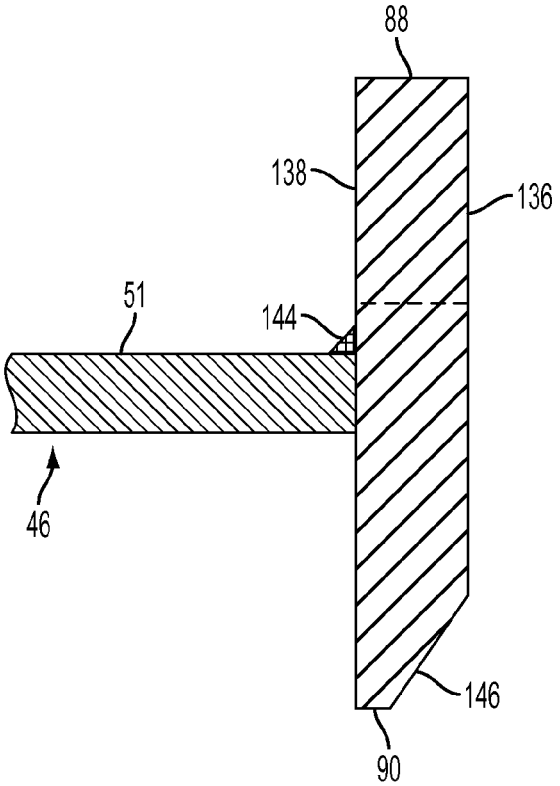
FIG. 16 is a cross-sectional view taken along line 16-16 in FIG. 15.

The door 16 can also include a diaphragm assembly 42. The diaphragm assembly 42 (FIG. 10) can include a sealing edge structure 44 and a pan 46, which can define a plurality of apertures 47. In one embodiment, the number of apertures 47 can be equal to the total of the number of bolts 40 plus the number of bolts 41, as shown in FIG. 10, such that each of the apertures 47 can receive a respective one of the bolts 40, 41. The sealing edge structure 44 can be attached to the pan 46 about a perimeter P (FIG. 5), as subsequently discussed further in conjunction with FIGS. 12, 13, 16 and 17. The diaphragm assembly 42 can also include a gasket 48, which can be interposed between the refractory structure 30 and the pan 46. The gasket 48 (FIG. 5) can define a plurality of apertures 49. The number of apertures 49 can be the same as the number of apertures 47 defined by the pan 46, and each of the apertures 49 can be aligned with a respective one of the apertures 47.

The door 16 can also include a gasket 50, which can be positioned in contact with a front surface 51 (FIGS. 5 and 10) of the pan 46. The gasket 50 can define a plurality of apertures 52, of a like number as the number of apertures 47 defined by the pan 46. Each of the apertures 52 can be aligned with one of the apertures 47. The door 16 can also include one or more rails, or plates, which can be positioned in contact with the gasket 50. As shown in FIGS. 5, 7 and 8, the door 16 can include two rails 53, spaced from one another. Each of the rails 53 can define a plurality of apertures 54. The total number of apertures 54 can be the same as the number of apertures 52 defined by gasket 50 and the number of apertures 47 defined by pan 46. Each of the apertures 54 can be aligned with a respective one of the apertures 52 and a respective one of the apertures 47.

The door 16 can also include a mainframe 56, which can include a perimeter flange 58 and a plurality of cross-members 59, which can have various configurations and can extend between opposite sides, or opposite ends, of the perimeter flange 58. In one embodiment, the refractory structure 30 and the diaphragm assembly 42 can each be coupled with the mainframe 56, using bolts 40, bolts 41, a plurality of nuts 60, a plurality of clamps 62 and a plurality of nuts 64. Each of the bolts 40 can extend through respective and aligned ones of the apertures 49, 47, 52, and 54, defined by the gasket 48, pan 46, gasket 50, and rails 53, respectively. Each one of the bolts 40 can also extend through a respective aperture 61 (FIG. 7) defined by the mainframe 56, and can be secured, by threaded engagement, to a respective one of the nuts 60.

Each of the bolts 41 can also extend through respective and aligned ones of the apertures 49, 47, 52 and 54. Each of the bolts 41 can also extend through an aperture 63 defined by a respective one of the clamps 62, and can be secured using a respective one of the nuts 64, by threaded engagement, which can force a body portion 66 (FIG. 8) of each clamp 62 against a respective one of the rails 53. The clamps 62 can be sized and configured such that an arm portion 67 (FIG. 8) of each clamp 62 can be spaced from the mainframe 56 by a relatively small gap, for example about 0.005 inches in one embodiment, when the body portion 66 is in contacting engagement with the respective rail 53. This configuration can permit the rails 53, gaskets 48 and 50, diaphragm assembly 42 and refractory structure 30 to slide relative to the mainframe 56, from the respective top end portions secured to mainframe 56 by bolts 40 and nuts 60, to accommodate thermal growth of the refractory structure 30 relative to the mainframe 56, due to the very high temperature within the interior chamber 18.

Figure 2:
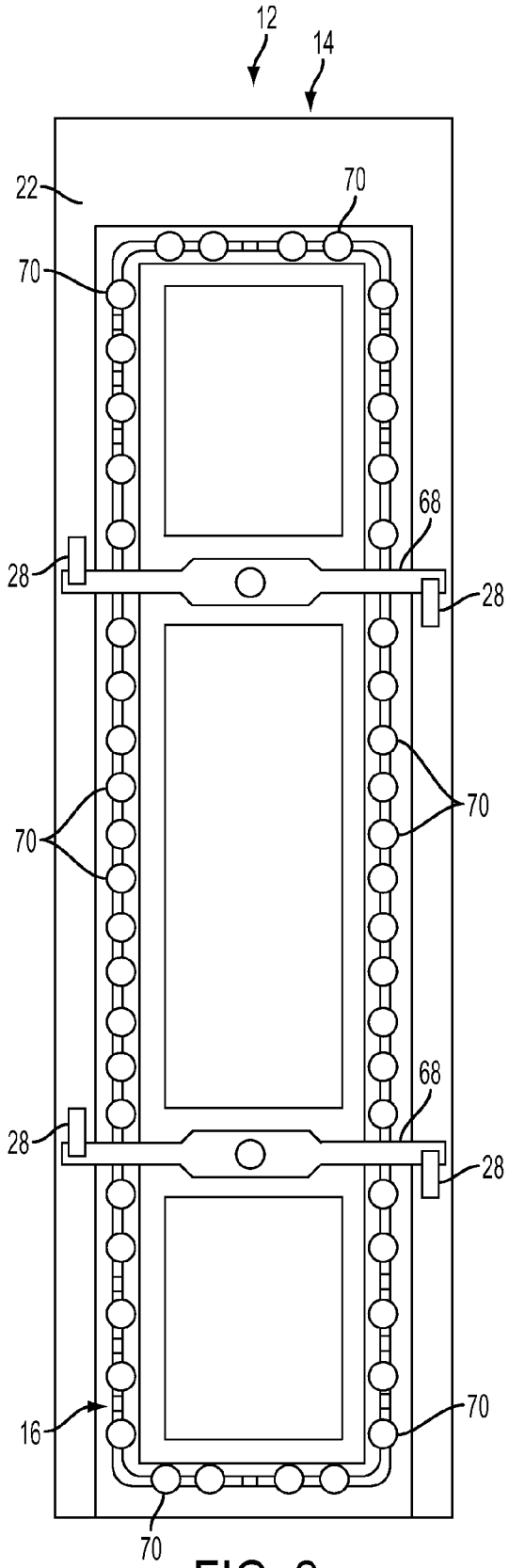
FIG. 2 is an enlarged front elevation view of one of the coke oven assemblies depicted in FIG. 1, with the respective door installed and closed.
Figure 3:
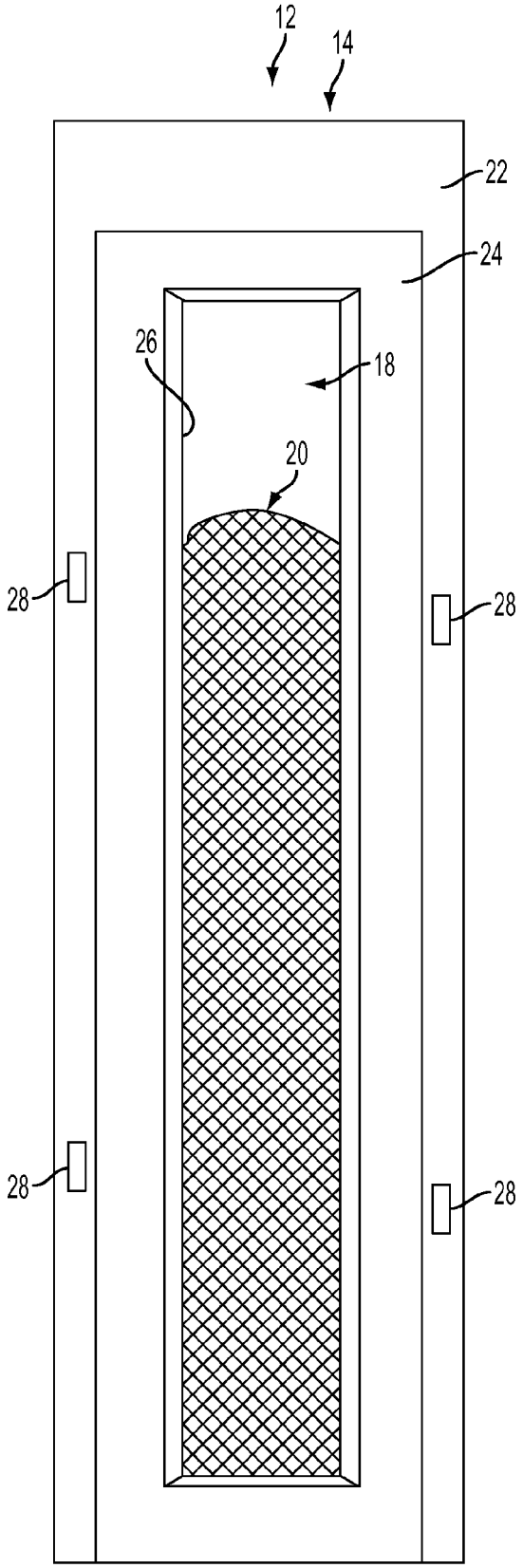
FIG. 3 is an enlarged front elevation view of the coke oven assembly shown in FIG. 1 without a door installed.

The mainframe 56 can include one or more latches 68 (FIGS. 2, 4, and 5), which can be rotatably coupled with one of the cross-members 59, for example via a respective post 69. In one embodiment, each of the doors 16 can include two of the latches 68, as shown in FIG. 2, with respect to one of the doors 16. Each latch 68 can engage an aligned pair of the attachment members 28 of the coke oven assembly 12, as shown in FIG. 2. Each latch 68 can be rotated about an axis defined by the respective post 69 as required to exert a desired force against the wall structure 22 of coke oven body 14, to releasably secure the door 16 to the coke oven body 14.

The door 16 can further include a plurality of load-exerting assemblies 70, which can be attached to the mainframe 56 as shown in FIG. 4. Each of the load-exerting assemblies 70 can include a casing 72 and a load-exerting member 74, which can be movable relative to the casing 72. In one embodiment, the casing 72 of each of the load-exerting assemblies 70 can be attached, for example welded, to the perimeter flange 58 of the mainframe 56.

Figure 9:
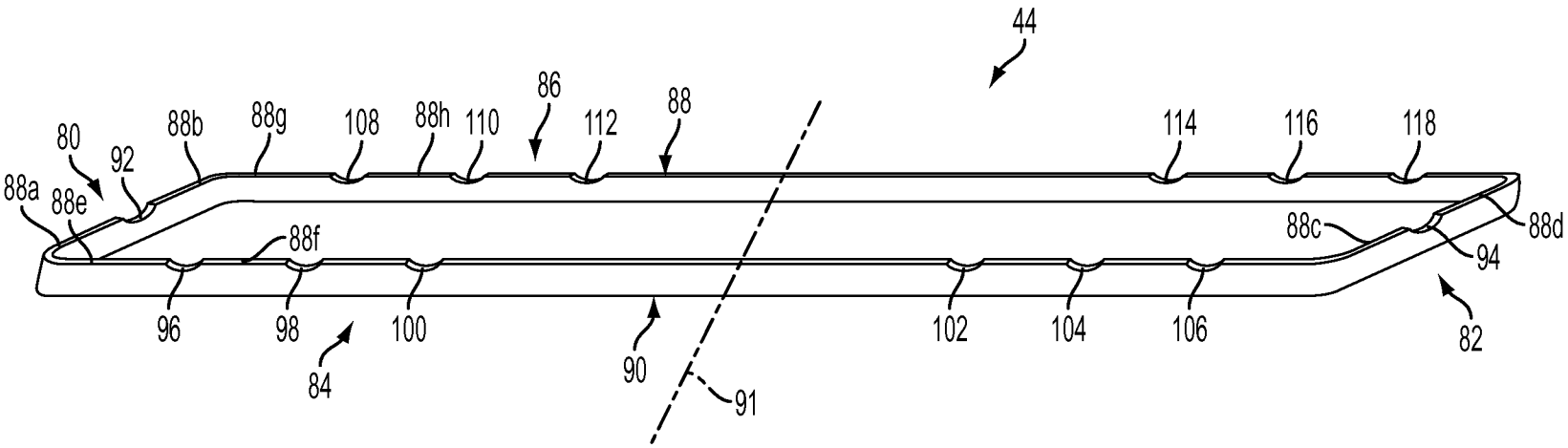
FIG. 9 is a perspective view of a sealing edge structure of a diaphragm assembly apart from the remaining components of the door of FIG. 5.

Referring to FIG. 9, the sealing edge structure 44 of the diaphragm assembly 42 can include a first end portion 80, a second end portion 82 spaced from the first end portion 80, a first side portion 84, and a second side portion 86 spaced from the first side portion 84. Each of the first side portion 84 and the second side portion 86 can extend between the first end portion 80 and the second end portion 82. In one embodiment, the first end portion 80, the second end portion 82, the first side portion 84, and the second side portion 86 can be integrally formed as a unitary structure from any suitable material, for example stainless steel. The sealing edge structure 44 can also include a load-receiving surface 88 and a door-sealing surface 90 spaced from the load-receiving surface 88. The door-sealing surface 90 can extend continuously around the sealing edge structure 44, throughout each of the first end portion 80, the second end portion 82, the first side portion 84 and the second side portion 86, as shown in FIG. 9.

A lateral centerline axis 91 (FIGS. 9 and 10) can be positioned midway, or about midway, between the first end portion 80 and the second portion 82 of the sealing edge structure 44. In one embodiment, the lateral centerline axis 91 can bisect the sealing edge structure 44 into first and second halves that are generally identical in shape, size and configuration, as shown in FIG. 9.

The sealing edge structure 44 can include a plurality of scallops. In one embodiment, the sealing edge structure 44 can include fourteen scallops, as shown in FIGS. 9 and 10. More particularly, the first end portion 80 of the sealing edge structure 44 can include a single scallop (e.g., 92), which can be positioned about midway between the first side portion 84 and the second side portion 86 of the sealing edge structure 44. The second end portion 82 of the sealing edge structure 44 can also include a single scallop (e.g., 94), which can also be positioned about midway between the first side portion 84 and the second side portion 86. The first side portion 84 of the sealing edge structure 44 can include scallops 96, 98, 100, 102, 104 and 106. As shown in FIGS. 9 and 10, the scallops 96, 98 and 100 can be positioned between the lateral centerline axis 91 and the first end portion 80. The scallops 102, 104 and 106 can be positioned between the lateral centerline axis 91 and the second end portion 82. The second side portion 86 of the sealing edge structure 44 can include scallops 108, 110, 112, 114, 116 and 118. The scallops 108, 110 and 112 can be positioned between the lateral centerline axis 91 and the first end portion 80. The scallops 114, 116, and 118 can be positioned between the lateral centerline axis 91 and the second end portion 82.

Each of the scallops 92, 94, 96, 98, 100, 102, 104, 106, 108, 110, 112, 114, 116, and 118 can be spaced from the door-sealing surface 90, and can extend from the load-receiving surface 88 toward the door-sealing surface 90, such that the load-receiving surface 88 extends discontinuously in each of the first end portion 80, the second end portion 82, the first side portion 84, and the second side portion 86, of the sealing edge structure 44. For example, the scallop 92 of the first end portion 80 can be positioned between portions 88*a* and 88*b* of the load-receiving surface 88, and the scallop 94 of the second end portion 82 can be positioned between portions 88*c* and 88*d* of the load-receiving surface 88. Similarly, each of the scallops 96, 98, 100, 102, 104, 106, 108, 110, 112, 114, 116 and 118 can be positioned between two respective portions of the load-receiving surface 88. For example, the scallop 96 of the first side portion 84 of the sealing edge structure 44 can be positioned between portions 88*e* and 88*f* of the load-receiving surface 88, and scallop 108 of the second side portion 86 of the sealing edge structure 44 can be positioned between portions 88*g* and 88*h* of the load-receiving surface 88.

Referring to FIGS. 11 and 14, the scallop 102 can include a concave surface 130 and a first arcuate transition surface 132 that can extend between the concave surface 130 and the load-receiving surface 88 of the sealing edge structure 44. Scallop 102 can also include a second arcuate transition surface 134 that can also extend between the concave surface 130 and the load-receiving surface 88. The concave surface 130 can have a radius of curvature R. In one embodiment, the radius of curvature R can be between about 3 inches and about 6 inches. In another embodiment, the radius of curvature R can between about 4.0 inches and about 4.5 inches. In yet another embodiment, the radius of curvature R can be about 4.25 inches. In other embodiments, the radius of curvature R can have different magnitudes. Each of the other scallops 92, 94, 96, 98, 100, 104, 106, 108, 110, 112, 114, 116, and 118 can have the same, or substantially the same, configuration.

Figure 17:
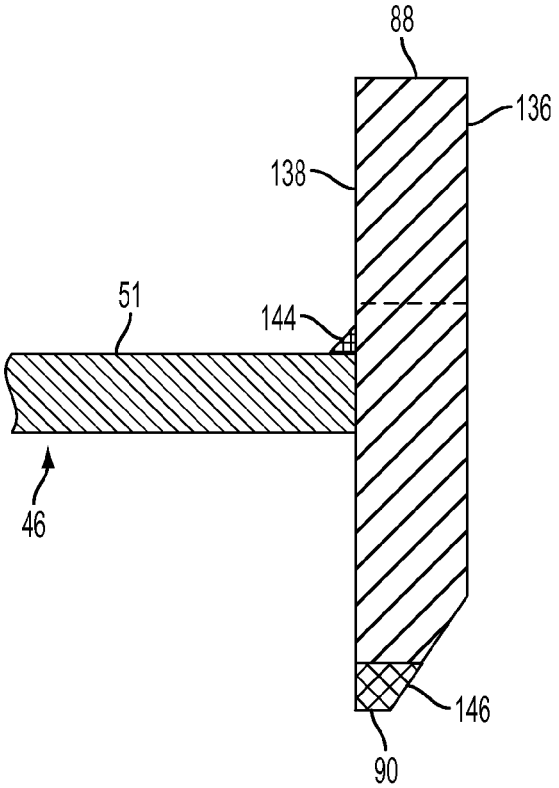
FIG. 17 is a cross-sectional view similar to FIG. 16, but with the tip of the sealing edge structure being formed from a different material than that shown in FIG. 16.

The sealing edge structure 44 can include an outer surface 136 and an inner surface 138. As shown in FIGS. 12, 13, 16 and 17, the pan 46 can be attached, for example, welded, to the inner surface 138 of the sealing edge structure 44. The pan 46 can include a pair of flanges 140 (one shown in FIGS. 12 and 13), which can extend along a respective one of the first side portion 84 and the second side portion 86 of the sealing edge structure 44. Each of the flanges 140 can be welded to the respective one of the first side portion 84 and the second side portion 86, for example as indicated at 142 in FIGS. 12 and 13 with respect to one of the flanges 140 and the first side portion 84. Each of the first end portion 80 and the second end portion 82 can be welded to the pan 46, between the first side portion 84 and the second side portion 86, as indicated at 144 in FIGS. 16 and 17 with respect to the pan 46 and the first end portion 80. In one embodiment, as shown in FIGS. 13 and 17, the sealing edge structure 44 can include a tip 146, which can include the door-sealing surface 90, and which can extend all around the sealing edge structure 44 through each of the first end portion 80, the second end portion 82, the first side portion 84 and the second side portion 86. The tip 146 can be made from any suitable wear-resistant material, such as any suitable hardfacing alloy. In one embodiment, the tip 146 can be made from a cobalt alloy, for example STELLITE®.

As shown in FIGS. 12 and 14, when sealing edge structure 44 is attached to pan 46, each scallop can have a scallop depth $d_1$ (shown for one of the scallops), which is a maximum distance from the load-receiving surface 88 to the concave surface 130, as measured in a direction parallel to the inner surface 138 of the sealing edge structure 44. The pan 46 can include a pan depth $d_2$, which is a maximum distance from the load-receiving surface 88 to the front surface 51 of the pan 46. The pan depth $d_2$ can be greater than the scallop depth $d_1$.

Referring to FIGS. 4, 5, 18A and 18B, each of the load-exerting assemblies 70 can be positioned and configured to selectively, operably apply a load, or force, to the load-receiving surface 88 of the sealing edge structure 44. As shown in FIGS. 4, 7 and 8, a portion of the diaphragm assembly 42, as indicated generally at 99, can extend beyond, or overhang, the refractory structure 30 about a perimeter of the diaphragm assembly 42. This portion can flex relative to a perimeter of the refractory structure 30 when loads are applied by the load-exerting assemblies 70 to the load-receiving surface 88 of the sealing edge structure 44.

The casing 72 can be hollow, and the load-exerting member 74 can extend through the casing 72. A distal end 150 (FIG. 18A) of the load-exerting member 74 can extend beyond the casing 72, proximate the load-receiving surface 88 of the sealing edge structure 44. A proximal end 152 (FIG. 18A) of the load-exerting member 74 can extend beyond an opposite end of the casing 72, and can be threaded. A coil spring 154 can be positioned in surrounding relationship with the load-exerting member 74, and one end of the coil spring 154 can contact the distal end 150 of the load-exerting member 74. A nut 156 can surround a portion of the load-exerting member 74, including a portion of the proximal end 152 (FIG. 18A) of the load-exerting member 74, and can be threaded into the casing 72. A distal end of the nut 156 can contact the coil spring 154. A nut 158 can be threaded onto the proximal end 152 of the load exerting member 74, to maintain an assembled configuration of the load-exerting assembly 70.

Figure 18A:
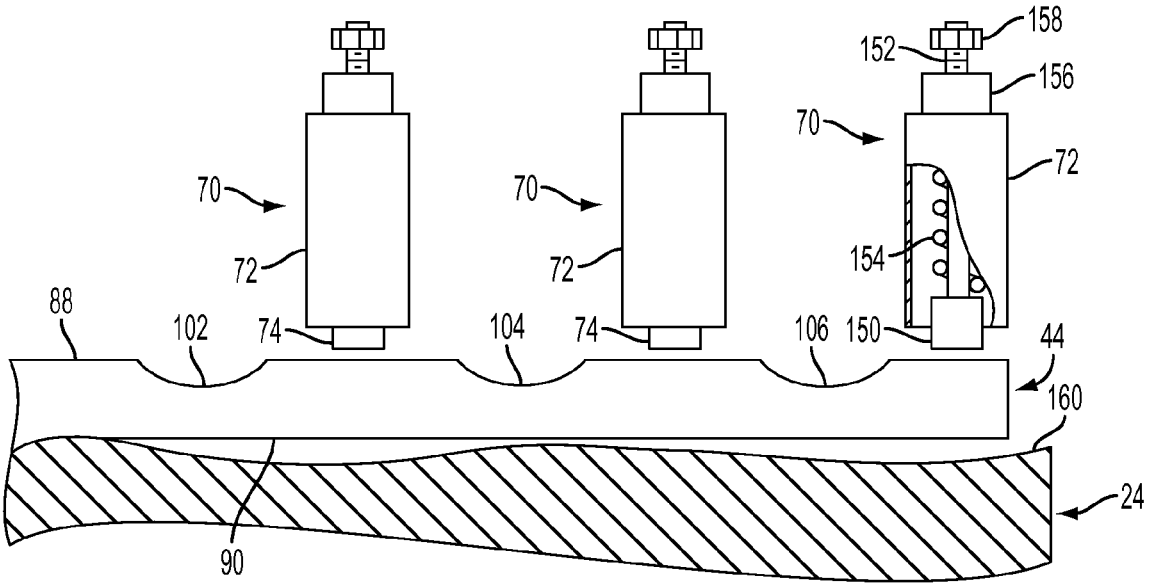
FIG. 18A is a schematic illustration of a portion of the sealing edge structure, and three load-exerting assemblies, of the door of FIG. 5, in association with a door jamb of a respective oven body, to which the door is releasably attached, with the door jamb being depicted as having a warped profile that is different than a shape of a door-sealing surface of the sealing edge structure, and with load-exerting members of the load-exerting assemblies depicted as being spaced from the sealing edge structure.
Figure 18B:
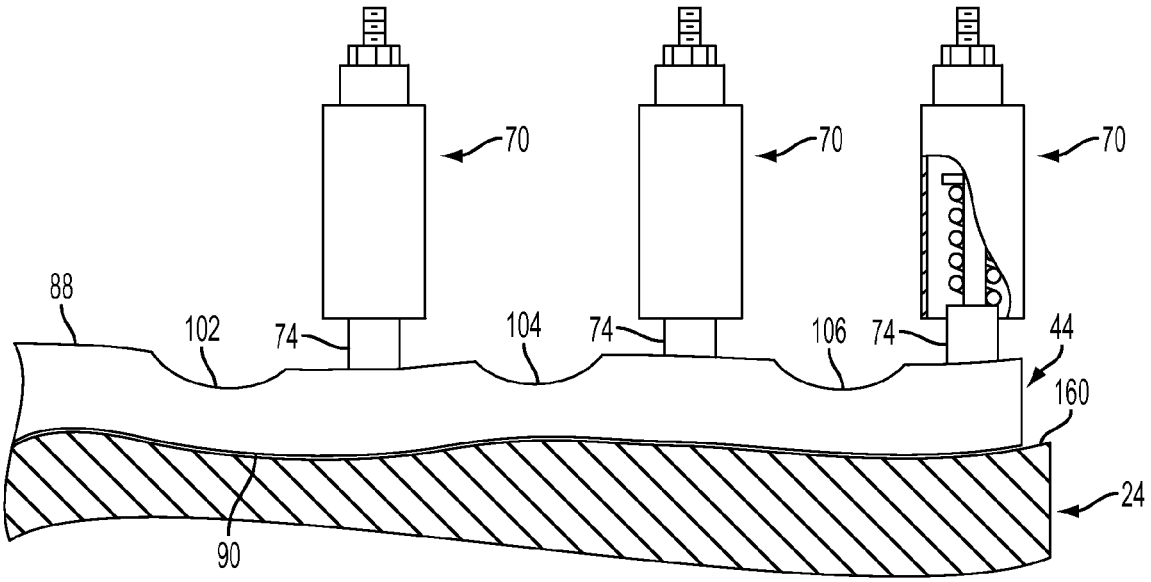
FIG. 18B is a schematic illustration similar to FIG. 18A, but with the load-exerting members of the load-exerting assemblies being depicted in contacting engagement with a load-receiving surface of the sealing edge structure and with the shape of the door-sealing surface of the sealing edge structure conforming with the warped profile of the door jamb, and in contacting engagement with the warped profile.

FIGS. 18A and 18B illustrate three of the load-exerting assemblies 70, in association with a portion of the first side portion 84 of the sealing edge structure 44, and a portion of the door jamb 24, with the door 16 releasably secured to the oven body 14 of one of the coke oven assemblies 12. As shown in FIGS. 18A and 18B, the door jamb 24 can have a warped profile, as indicated generally at 160, which can result from its prolonged exposure to the high temperature within the interior chamber 18 defined by the oven body 14. As shown in FIG. 18A, with the sealing edge structure 44 in a relaxed configuration, and the load-exerting assemblies 70 spaced from the sealing edge structure 44, gaps can exist between the door-sealing surface 90 and the door jamb 24, which can permit gases to escape from the interior chamber 18 to atmosphere, which is undesirable. The load-exerting assemblies 70 can be used to selectively, and individually, apply loads, or forces, to respective portions of the load-receiving surface 88 of the sealing edge structure 44, so that the door-sealing surface 90 of the sealing edge structure 44 is caused to deflect as required to conform with the warped profile 160 of the door jamb 24, as shown in FIG. 18B. In this configuration, the door-sealing surface 90 can be in contacting, and at least substantially sealing (i.e., entirely sealing or substantially entirely sealing), engagement with the door jamb 24.

Torquing the nut 156 in one direction can cause the coil spring 154 to compress and exert an increased force on the load-deflecting member 74 and the load-receiving surface 88 of the sealing edge structure 44, while torquing the nut 156 in the opposite direction can allow the coil spring 154 to expand, resulting in a decreased force being exerted on the load-exerting member 74 and the load-receiving surface 88 of the sealing edge structure 44.

The sealing edge structure 44 of door 16 can have significantly more (e.g., approximately twice) flexibility as compared with conventional sealing edges as a result of the included scallops, for example scallops 92, 94, 96, 98, 100, 102, 104, 106, 108, 110, 112, 114, 116, and 118, thus providing enhanced conformance of the door-sealing surface 90 of the sealing edge structure 44 with the profile (e.g., 160) of severely warped door jambs of coke ovens, as compared to that achieved with conventional sealing edges of coke oven doors. In one embodiment, the increased flexibility can be concentrated at the top and bottom ends of the sealing edge structure 44, specifically at the four corners.

The increased flexibility of the sealing edge structure 44 can be achieved by providing scallops (e.g., 92, 94, etc.) in the sealing edge structure 44 at specific locations between the load-exerting assemblies 70, which reduces the profile, or cross-sectional area of the sealing edge structure 44 within the scallops, as will be appreciated with reference to FIGS. 1-18B. The reduced profile of the sealing edge structure 44 at the locations of the scallops can allow greater flexibility of the sealing edge structure 44 in specific locations with reduced force applied to the sealing edge structure by the load-exerting members 74 of the individual load-exerting assemblies 70. Increased flexibility of the sealing edge structure 44 with less applied force can reduce or eliminate mounting imbalance of the door 16, and can reduce or eliminate seal leaks. It will be appreciated that scallops can be provided in a sealing edge structure of a door of a coke oven assembly in any of a variety of other suitable configurations.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art.

What is claimed is:

1. A coke oven assembly comprising:

an oven body defining an interior chamber configured to receive a product to be heated, the oven body comprising:

a wall structure; and a door jamb attached to the wall structure and defining an opening in communication with the interior chamber; and a door, the door comprising:

a diaphragm assembly comprising a pan and a sealing edge structure, the sealing edge structure being attached to the pan about a perimeter of the pan, the sealing edge structure comprising:

a load-receiving surface, a door-sealing surface spaced from the load-receiving surface, a first end portion, a second end portion spaced from the first end portion, a first side portion, and a second side portion spaced from the first side portion, each of the first side portion and the second side portion extending between the first end portion and the second end portion, the door-sealing surface extending continuously around the sealing edge structure, throughout each of the first end portion, the second end portion, the first side portion, and the second side portion; and a plurality of scallops, each of the scallops comprising a concave surface, a first arcuate transition surface, and a second arcuate transition surface, wherein each of the first arcuate transition surface and the second arcuate transition surface extends between the concave surface and the load-receiving surface, wherein the plurality of scallops define a first grouping of scallops of the first side portion concentrated toward the first end portion, a second grouping of scallops of the first side portion concentrated toward the second end portion, a third grouping of scallops of the second side portion concentrated toward the first end portion, and a fourth grouping of scallops of the second side portion concentrated toward the second end portion;

a mainframe releasably secured to the door jamb, the diaphragm assembly being coupled with the mainframe; and a plurality of load-exerting assemblies attached to the mainframe, each of the load-exerting assemblies being positioned and configured to selectively, operably apply a load to the load-receiving surface of the sealing edge structure;

wherein, the scallops are configured and positioned to facilitate deflection of the sealing edge structure, in response to loads applied to the load-receiving surface of the sealing edge structure, such that the door-sealing surface is positioned in contacting, and at least substantially sealing, engagement with the door jamb;

wherein with respect to the first side portion, there are at least two different distances spacing adjacent ones of the scallops; and wherein with respect to the second side portion, there are at least two different distances spacing adjacent ones of the scallops.

2. The coke oven assembly of claim 1, wherein:

the door further comprises a refractory structure coupled with the diaphragm assembly; and the mainframe is releasably secured to the door jamb such that the refractory structure is positioned, at least substantially, within the interior chamber defined by the oven body.

3. The coke oven assembly of claim 1, wherein:

the first end portion, the second end portion, the first side portion, and the second side portion of the sealing edge structure cooperate to define an opening having a generally rectangular shape; and the pan closes the opening.

4. The coke oven assembly of claim 3, wherein:

each of the first end portion and the second end portion comprises at least one of the scallops.

5. The coke oven assembly of claim 1, wherein:

the sealing edge structure further comprises an outer surface and an inner surface, the pan being attached to the inner surface of the sealing edge structure;

each of the scallops comprises a scallop depth, the scallop depth comprising a maximum distance from the load-receiving surface to the concave surface as measured in a direction parallel to the inner surface of the sealing edge structure;

the pan comprises a front surface and a pan depth, the pan depth comprising a maximum distance from the load-receiving surface to the front surface of the pan as measured in a direction parallel to the inner surface of the sealing edge structure; and the pan depth is greater than the scallop depth.

6. The coke oven assembly of claim 1, wherein:

the sealing edge structure further comprises a tip;

the tip comprises the door-sealing surface of the sealing edge structure; and the tip is formed from a hardfacing alloy.

7. The coke oven assembly of claim 1, wherein:

the first end portion of the sealing edge structure comprises one of the plurality of scallops, the one of the plurality of scallops being positioned about midway between the first side portion and the second side portion of the sealing edge structure; and the second end portion of the sealing edge structure comprises another one of the plurality of scallops, the another one of the plurality of scallops being positioned about midway between the first side portion and the second side portion of the sealing edge structure.

8. The coke oven assembly of claim 1, wherein:

the sealing edge structure defines a lateral centerline axis, the lateral centerline axis being equidistant from the first end portion of the sealing edge structure and the second end portion of the sealing edge structure;

the first grouping of scallops of the first side portion is positioned between the lateral centerline axis and the first end portion;

the second grouping of scallops of the first side portion is positioned between the lateral centerline axis and the second end portion;

the third grouping of scallops of the second side portion is positioned between the lateral centerline axis and the first end portion; and the fourth grouping of scallops of the second side portion is positioned between the lateral centerline axis and the second end portion.

9. The coke oven assembly of claim 8, wherein:

the lateral centerline axis bisects the sealing edge structure into first and second halves that are generally identical in shape, size and configuration.

10. The coke oven assembly of claim 8, wherein:

the first grouping of scallops of the first side portion comprises at least two of the scallops;

the second grouping of scallops of the first side portion comprises at least two of the scallops;

the third grouping of scallops of the second side portion comprises at least two of the scallops; and the fourth grouping of scallops of the second side portion comprises at least two of the scallops.

11. The coke oven assembly of claim 10, wherein:

the first end portion of the sealing edge structure comprises one of the plurality of scallops, the one of the plurality of scallops being positioned about midway between the first side portion and the second side portion of the sealing edge structure; and the second end portion of the sealing edge structure comprises another one of the plurality of scallops, the another one of the plurality of scallops being positioned about midway between the first side portion and the second side portion of the sealing edge structure.

12. The coke oven assembly of claim 10, wherein:

the first grouping of scallops of the first side portion comprises exactly three of the scallops;

the second grouping of scallops of the first side portion comprises exactly three of the scallops;

the third grouping of scallops of the second side portion comprises exactly three of the scallops; and the fourth grouping of scallops of the second side portion comprises exactly three of the scallops.

13. The coke oven assembly of claim 12, wherein:

the first end portion of the sealing edge structure comprises one of the plurality of scallops, the one of the plurality of scallops being positioned about midway between the first side portion and the second side portion of the sealing edge structure; and the second end portion of the sealing edge structure comprises another one of the plurality of scallops, the another one of the plurality of scallops being positioned about midway between the first side portion and the second side portion of the sealing edge structure.

* * * * *